US008539714B2

(12) United States Patent
Muñoz-Cruzado Sánchez

(10) Patent No.: US 8,539,714 B2
(45) Date of Patent: Sep. 24, 2013

(54) ADVERTISING BARRIER COMPLEMENTING VEHICLE ACCESS CONTROL BARS

(76) Inventor: Jose Muñoz-Cruzado Sánchez, Rota (ES)

( * ) Notice: Subject to any disclaimer, the term of this patent is extended or adjusted under 35 U.S.C. 154(b) by 253 days.

(21) Appl. No.: 13/119,226

(22) PCT Filed: Oct. 23, 2009

(86) PCT No.: PCT/ES2009/000511

§ 371 (c)(1),
(2), (4) Date: Mar. 16, 2011

(87) PCT Pub. No.: WO2010/049552

PCT Pub. Date: May 6, 2010

(65) Prior Publication Data

US 2011/0192086 A1 Aug. 11, 2011

(30) Foreign Application Priority Data

Oct. 27, 2008 (ES) ..... 200803050

(51) Int. Cl.
*E01F 13/06* (2006.01)

(52) U.S. Cl.
USPC ..... 49/49; 40/601

(58) Field of Classification Search
USPC ..... 49/49; 40/601; 404/10
See application file for complete search history.

(56) References Cited

U.S. PATENT DOCUMENTS

| | | | | |
|---|---|---|---|---|
| 3,589,066 | A * | 6/1971 | Fisher | 49/35 |
| 4,062,149 | A * | 12/1977 | Collins | 49/49 |
| 4,897,960 | A * | 2/1990 | Barvinek et al. | 49/49 |
| 5,437,907 | A * | 8/1995 | Peil et al. | 428/143 |
| 5,984,569 | A * | 11/1999 | Chou | 404/6 |
| D474,245 | S * | 5/2003 | Abro | D14/203.7 |
| 6,618,993 | B2 * | 9/2003 | Burke | 49/49 |
| 7,193,529 | B1 * | 3/2007 | Shah | 340/907 |
| 2002/0124447 | A1 * | 9/2002 | Burke | 40/606 |
| 2005/0060936 | A1 * | 3/2005 | Burke | 49/49 |
| 2005/0102872 | A1 * | 5/2005 | Seguin et al. | 40/601 |
| 2008/0000156 | A1 * | 1/2008 | Stoffels et al. | 49/49 |
| 2008/0148637 | A1 * | 6/2008 | Pate | 49/49 |

FOREIGN PATENT DOCUMENTS

| | | | |
|---|---|---|---|
| CN | 201109900 | Y | 9/2009 |
| DE | 9411150 | U1 | 9/1994 |
| EP | 1715101 | A1 | 10/2006 |
| FR | 2762339 | A1 | 10/1998 |
| NL | 1011461 | C1 | 9/2009 |

* cited by examiner

*Primary Examiner* — Katherine Mitchell
*Assistant Examiner* — Justin Rephann
(74) *Attorney, Agent, or Firm* — The Law Firm of Andrea Hence Evans, LLC

(57) ABSTRACT

A gate operator system featuring board display attachment for a lift-gate at the vehicle access control point. The system features board display attached to the lift-gate, which moves in a synchronous motion with the lift gate. At least 3 hooks are placed at an appropriate distance according to the situation where the advertisement boards attach. The attachment takes place by threading the hooks through the perforations located at the top and center of the advertisement boards and locking them in place while allowing them free movement within a 90 degree range. The hooks are placed at different intervals (distances) from the operating mechanism.

8 Claims, 2 Drawing Sheets

ADVERTISING BARRIER COMPLEMENTING VEHICLE ACCESS CONTROL BARS

FIELD OF THE INVENTION

The present invention relates in general to an attachment for automatic access lift-gates whereby both the attachment and the lift-gate will raise and lower simultaneously.

BACKGROUND OF THE INVENTION

Automatic access lift-gate is widely used to control private parking lots, prevents access to unregistered vehicles, prevent access in case of imminent danger, deny access due to lack of payment, controls vehicle flows inside parking lot, and many more uses.

Exterior advertising is normally placed in public areas. It's targeted to an unspecified audience, and consists of posters, billboards, lighted banners, and all installations that are displayed in a public place.

There are several types of exterior advertising. The media platforms in which they are displayed are widely varied. The media used for exterior advertising include all those that can be displayed in open or closed public places. The most common media being billboards, posters, lighted banners, advertising banners printed or on canvas on public transportation, private vehicles, trucks, vans taking advantage of the vehicles exterior surface to place advertisements. Advertising vehicles such as trucks carrying billboards, or trucks with retractable structures for banners, flags, façade or scaffolding banners, lighted banners, hatches and urban furniture. There are also automatic access lifts that when in the horizontal position display strips that are suspended perpendicularly to the lift-gate.

Existing advertising technology presents the following shortcomings billboards are hard to see because of their locations. Posters are too small to be seen by passersby. Banners on moving vehicles pass by at an excessive speed that don't allow for a lasting visual impact. Similar problems exists regarding vehicles designed exclusively for advertising. The public can't see flags if the wind isn't blowing. The lift-gates that display ribbons perpendicularly when in the horizontal position are designed to be seen clearly by the drivers but contain no advertising.

SUMMARY OF THE INVENTION

This invention introduces an attached advertisement board using the automatic access lift-gate as the advertisement medium by attaching the device to the underside of the automatic lifter and following its ascending and descending movement. The boards on the device display the advertisements as it lowers, the horizontal positioning of the advertising boards makes them widely visible, allowing for a good number of viewer hits.

An aspect of an embodiment of the invention provides a device that draws attention to the advertisement or text on the lifts.

A further aspect of an embodiment of the invention provides a device that is easy to assemble and disassemble.

A further aspect of an embodiment of the invention provides a device that does not require special measures or modifications.

Additional aspects, objectives, features and advantages of the present invention will become apparent from the following description of the preferred embodiments with reference to the attached drawings.

DETAILED DESCRIPTION OF THE INVENTION

Figure 1:
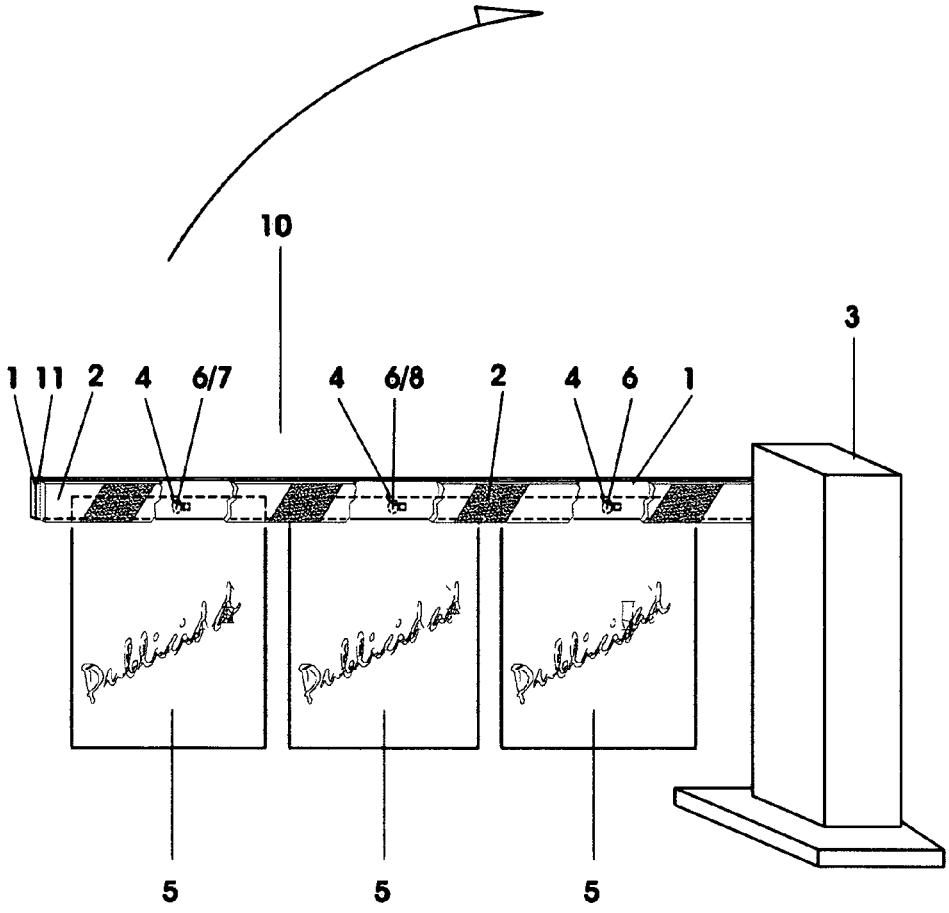
FIG. 1 is a raised front view of the board display attached to the access control barrier in the closed position.

The invention features an advertisement board (5) for the automatic lift-gate (2), as shown in FIG. 1. The lift gate 2 is an arm that moves in an open or upward direction or a closed or downward direction. The lift gate 2 is connected to the operating mechanism 3. The advertisement board (5) is made of aluminum, coated with white enamel or another appropriate coating material, such as fiber glass. The board (5) can be made of other materials that can withstand harsh weather conditions. Reflective bands are positioned on both sides of the advertisement board (5). Reflective bands are also located behind the automatic lift (2), attached to it with the appropriate support, with the same dimensions (measurements), moving in synchrony with the lift. The side of the lift gate 2 acts as an advertising display and features three evenly spaced metallic hooks 7, 8, and 15, where rectangular advertisement boards 5 can be attached to each of the hooks. Additional or less hooks and corresponding boards may be attached to the lift gate. It is preferred that the boards 5 do not reach the ground; however boards of various sizes may be attached to the hooks. The advertisement boards are perforated having a hole 6 at the center of the top side of the board and can be attached and locked to the hooks, while allowing free movement within a 90-degree range. The hooks are threaded through the perforations located at the top and center of the advertisement boards; locking them in place while allowing them free movement within a 90 degree range. The boards are installed in the same plane as the lift gate. They are installed at the bottom of the gate and they are subject to the rotation of the lift-gate mechanism as it raises and lowers.

The hooks are installed at different intervals on the automatic lift-gate in an order that facilitates display of the advertising boards. A first hook 7 is positioned along the lift gate towards an end of the lift gate that is the furthest from the lift-gate operating mechanism. A second hook 8 is positioned between the first hook and the third hook 15 in the middle of the lift gate. The third hook 15 positioned closest to the lift gate operating mechanism 3. The operating mechanism 3 controls the opening and closing of the arm 2. The hooks 7,8 and 15 are positioned such that when the lift gate 2 rises the advertisement boards 5 rotate, aligning with the lift, thus allowing all three displays to remain visible during the lift-gate movement. The advertisement boards are reusable, and can be replaced at any given moment.

Figure 2:
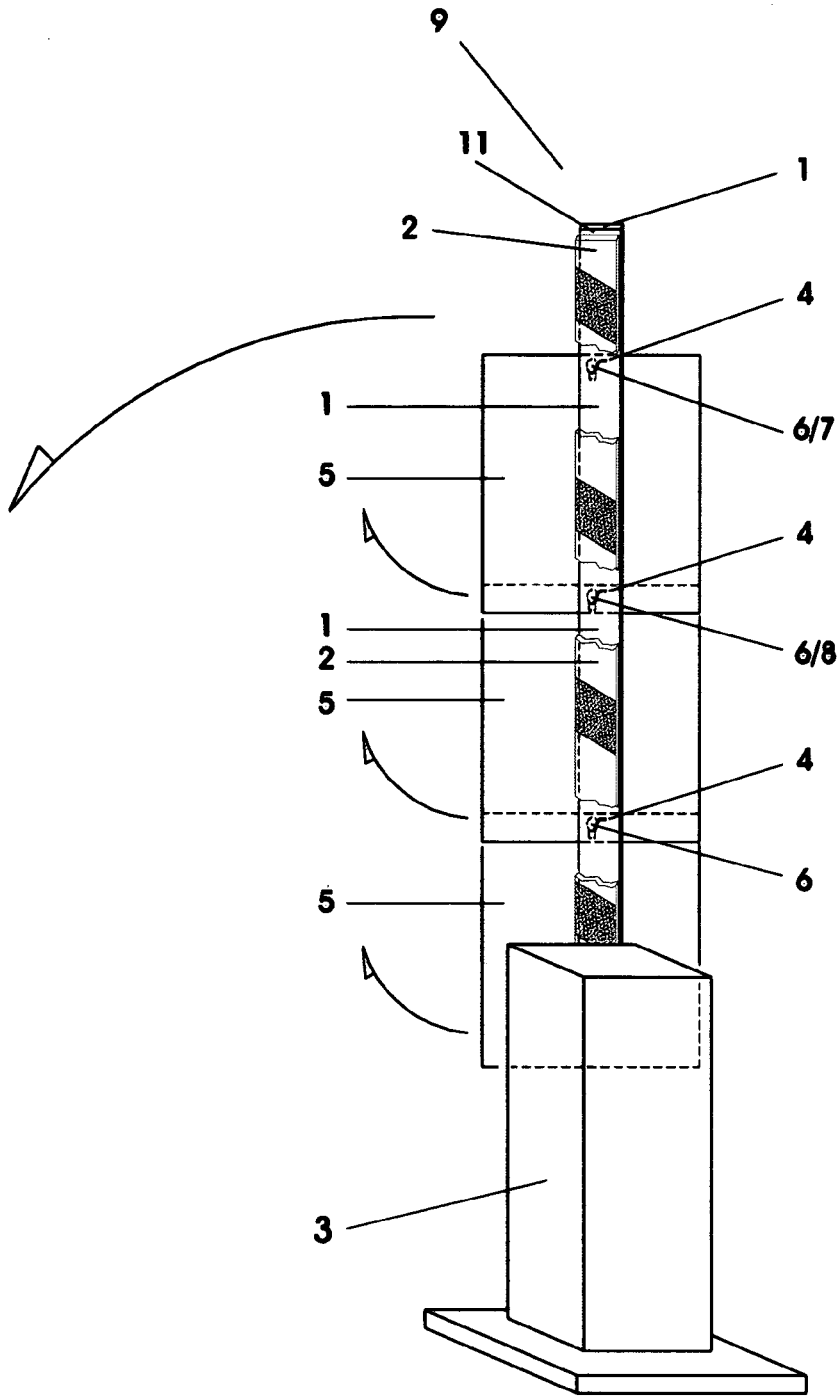
FIG. 2 is a raised front view of the board display attached to the access control barrier in the open position.

In operation, the operating mechanism raises the automatic lift-gate vertically. The descending movement of the lift-gate 2 allows the advertisement boards 5 to rotate and become perpendicular to the floor and to the lift-gate as a result of gravity, as shown in FIG. 1 by element 10. Upon raising the lift-gate, the advertisement boards will rotate and align vertically with it, as shown in FIG. 2 by element 9. Both the lowering and the raising of the lift-gate can be automatic or manual. Alternate lifting mechanisms may be used to the access lift-gate.

The advertisement board can have different shapes other than rectangular. Furthermore, the attachment mechanism may vary and feature attaching the boards to the lift gate by alternate means such that the boards and move freely in a 90. Additionally, the advertisement can be attached directly to the lift-gate if the attachment board cannot be installed on the lift. In a different application, the advertisement board display can be attached to other (vehicle) access gates. The advertisement board display is installed on the same plane as the lift, at the bottom of it and the attached display 5 is subject to the rotation of the lift-gate mechanism as it raises and lowers. Another application is when the advertisement board attachment is located behind the lift, and not attached to it, but to the rotating pulley that controls the vertical movement. In the instance that a display board attachment couldn't be placed, the advertisement boards can be attached to the lift-gate at the vehicle access point.

The invention has been described in detail with particular reference to certain preferred embodiments thereof, but it will be understood that variations and modifications can be effected within the spirit and scope of the invention.

The invention claimed is:

1. A gate operator system comprising:

an operating mechanism;

a lift gate controlled by the operating mechanism, wherein the lift gate has a front planar surface;

wherein the lift gate features connectors on the lift gate; and board displays attached to the connectors, wherein at least a top portion of the board displays are aligned along and in direct contact with the front planar surface and evenly distributed such that the boards pivot with respect to the lift gate within a 90 degree range when the lift gate is in an open position.

2. The system of claim 1, wherein the lift gate comprises reflective bands.

3. The system of claim 1, wherein the board displays comprise holes at a center of a top of the board displays, wherein the connectors are attached to the board displays by the holes.

4. The system of claim 1, wherein the connectors are hooks positioned at different intervals evenly distributed along the front planar surface such that a first hook is positioned along the lift gate at a first end of the lift gate, a third hook is at a second end of the lift gate, and a second hook is positioned between the first hook and a third hook 15 in the middle of the lift gate.

5. The system of claim 4, wherein the third hook 15 is positioned closest to the lift gate operating mechanism.

6. A gate operator system comprising:

an operating mechanism;

a lift gate controlled by the operating mechanism, wherein the lift gate has a front planar surface, wherein the lift gate features at least three board displays attached to a surface of the lift gate, each of the at least three board displays have top portions that are aligned along and in direct contact with the front planar surface, wherein the at least three board displays pivot with respect to the lift gate within a 90 degree range and remain visible when the lift gate is in an open position.

7. The system of claim 6, wherein the boards feature an advertisement.

8. The system of claim 6, wherein the boards are attached to the lift gate along the front planar surface, wherein the boards move freely within a 90 degree range as the lift gate is raised or lowered.

* * * * *